United States Patent [19]

Iwasaki et al.

[11] Patent Number: 4,864,318

[45] Date of Patent: Sep. 5, 1989

[54] ANTENNA DEVICE FOR A SYSTEM INCLUDING CORDLESS APPARATUSES A CABLE WITH BUILT IN ANTENNA HAVING CONTINUOUSLY REPEATED PATTERN CONDUCTORS

[75] Inventors: Yoshiki Iwasaki, Yokohama; Shizuyoshi Satoh; Kenichi Urushibata, both of Kanuma; Tasuko Koizumi, Tokyo; Noriyuki Tago, Osaka; Fusao Muta, Tokyo, all of Japan

[73] Assignees: Victor Company of Japan, Limited, Kanagawa; Sumitomo Elecric Industries, Ltd., Osaka, both of Japan

[21] Appl. No.: 90,650

[22] Filed: Aug. 28, 1987

[30] Foreign Application Priority Data

Sep. 2, 1986 [JP] Japan ..... 61-206486

[51] Int. Cl.[4] ..... H01Q 1/36; H01Q 9/20

[52] U.S. Cl. ..... 343/720; 343/795; 343/905; 174/115

[58] Field of Search ..... 343/795, 700 MS, 806, 343/810, 813, 905, 790, 792, 824, 826, 827, 720; 333/236, 238; 174/115, 117 PC

[56] References Cited

U.S. PATENT DOCUMENTS

| | | | |
|---|---|---|---|
| 2,286,827 | 6/1942 | Morrison | 174/115 |
| 2,412,249 | 12/1946 | Brown et al. | 343/795 |
| 2,919,441 | 12/1959 | Chu | 343/905 |
| 3,016,536 | 1/1962 | Fubini | 343/829 |
| 4,204,213 | 5/1980 | Wheeler et al. | 343/813 |
| 4,205,317 | 5/1980 | Young | 343/811 |
| 4,527,163 | 7/1985 | Stanton | 343/700 MS |

FOREIGN PATENT DOCUMENTS

| | | | |
|---|---|---|---|
| 27245 | 3/1977 | Japan | 343/905 |
| 53904 | 4/1980 | Japan | 343/700 MS |

*Primary Examiner*—Rolf Hille
*Assistant Examiner*—Michael C. Wimer
*Attorney, Agent, or Firm*—Jordan and Hamburg

[57] ABSTRACT

An antenna device for a system which includes cordless apparatuses, e.g. home automation system. Conductive patterns or conductive wires are provided on a conduit, which may comprise a round or a flat composite cable, for radiating signals to and receiving signals.

7 Claims, 5 Drawing Sheets

ANTENNA DEVICE FOR A SYSTEM INCLUDING CORDLESS APPARATUSES A CABLE WITH BUILT IN ANTENNA HAVING CONTINUOUSLY REPEATED PATTERN CONDUCTORS

BACKGROUND OF THE INVENTION

The present invention relates to an antenna device in a form of printed or inlaid conductor in a surface of conduit and used for a wireless system which includes cordless apparatuses such as a home telephone system, a home automation system, a home bath system, or a factory automation system.

A home automation (HA) system is one of the systems of the kind described and now a popular installation in ordinary houses. An HA system may include telephone sets and fire alarms which are located in individual rooms of a house, an electric lock, and others which are commonly connected to a system controller by a distributing cable to be controlled thereby. The system controller is installed in one of the rooms and connected to a public telephone line. Connected to another public telephone line is a cordless telephone system which includes a central unit fixedly located in one of the rooms, and at least one mobile unit located in another room. A problem with such a cordless telephone system which is not directly connected to the system controller is that a communication between, for example, the mobile unit or cordless telephone and any of the telephones connected to the system controller must be done through the respective public telephone lines and their exchange. Further, while a communication is established between the central and mobile units of the cordless telephone system, the electromagnetic wave must propagate through the walls which intervene between the central and mobile units. This brings about the need for intense electromagnetic power outputs because those walls are usually made of materials which tend to attenuate or obstruct the propagation of electromagnetic waves.

In the light of the above, there has been proposed a system in which an antenna is installed in each room and connected to a distributing cable via an exclusive duplexer, the cable being connected to a system controller having a transmit/receive circuit. This implementation allows an electromagnetic wave to be directly propagated through the space without the interference of walls and others, whereby the distance of transmission and reception of an electromagnetic wave and, therefore, the intensity of electromagnetic wave required is cut down.

However, the prior art system described above has a drawback that installing duplexers one for each antenna requires complicated and, therefore, time- and labor-consuming work which adds to the cost.

SUMMARY OF THE INVENTION

It is, therefore, an object of the present invention to provide an antenna device which makes a system including cordless apparatuses inexpensive and the installation thereof simple.

It is another object of the present invention to provide a generally improved antenna device for a system which includes cordless apparatuses., An antenna device for a system which includes a cordless apparatus of the present invention comprises a conduit and a conductor provided on the conduit and having a predetermined pattern for radiating a signal to and receiving a signal from the cordless apparatus.

The conduit may be a sheath of wire for supplying house current or for telephone, or for carrying audio or video signals, or a utility pipe for water gas, oil etc having an electrically insulative surface.

The above and other objects, features and advantages of the present invention will become more apparent from the following detailed description taken with the accompanying drawings.

DESCRIPTION OF THE PREFERRED EMBODIMENTS

To better understand the present invention, exemplary prior art HA systems will be described with reference to FIGS. 1 to 3.

Figure 1:
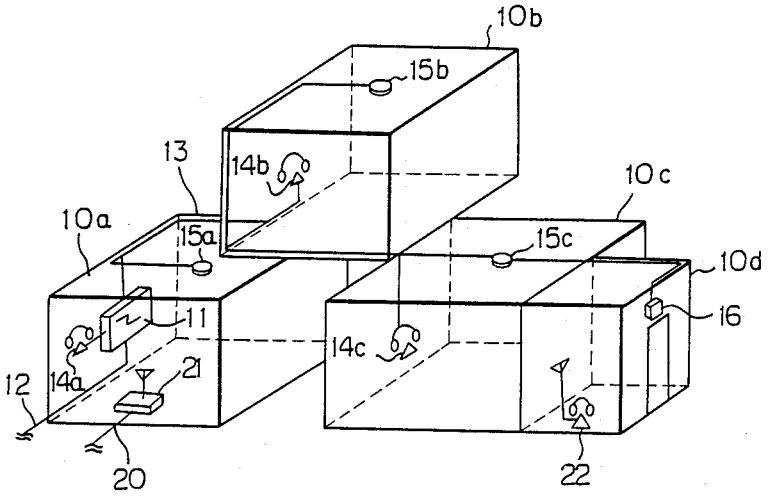
Fig. 1 PRIOR ART
FIG. 1 is a schematic view of an exemplary prior art HA system.
Figure 2:
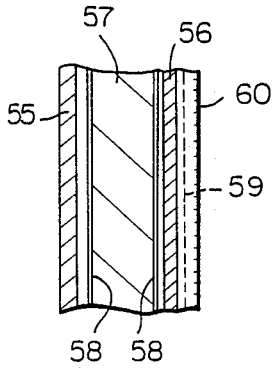
Fig. 2 PRIOR ART
FIG. 2 is a section showing an example of wall structures.

Referring to FIG. 1, a prior art HA system includes a system controller 11 which is installed in a dining room 10*a* of a house and connected to a public telephone line 12. A distributing cable 13 extends from the system controller 11 to a bedroom 10*b*, a living room 10*c*, and an entrance 10*d* to be connected to telephone sets 14*a* to 14*c*, fire alarms 15*a* to 15*c*, an electric lock 16, and others. In this configuration, the equipment 14*a* to 14*c*, 15*a* to 15*c* and 16 are controlled by the system controller 11. Also installed in the dining room 10*a* is a central unit 21 of a cordless telephone system which is connected to another public telephone line 20. A mobile unit 22 of the cordless telephone system is located at the entrance 10*d*.

The mobile unit 22 of the cordless telephone system is associated on a one-to-one basis with the central unit 21, said those cordless apparatuses are not directly connected to the HA system. This brings about a drawback that communication cannot be established between, for example, the mobile unit 22 and the telephone set 14*b* without the intermediary of the public telephone lines 12 and 20 and their associated exchange. On the other hand, as shown in FIG. 2, an ordinary wall adapted to partition nearby rooms includes outer panels 55 and 56, and heat insulator 57 which fills the space between the panels 55 and 56. The heat insulator 57 is covered with aluminum foil 58. The surface of the panel 56 on the room side is covered with a wire net 59 and, then, with a finishing material 60. The aluminum foil 58, wire net 59, heat insulator 57, and panels 55 and 56 which are made of wood tend to attenuate or obstruct the propagation of an electromagnetic wave. Hence, when the central unit 21 and the mobile unit 22 of the cordless telephone system are disposed in independent rooms as shown in FIG. 1, secure communications cannot be achieved unless both the central unit 21 and the mobile unit 22 emit intense high power electromagnetic waves.

Figure 3:
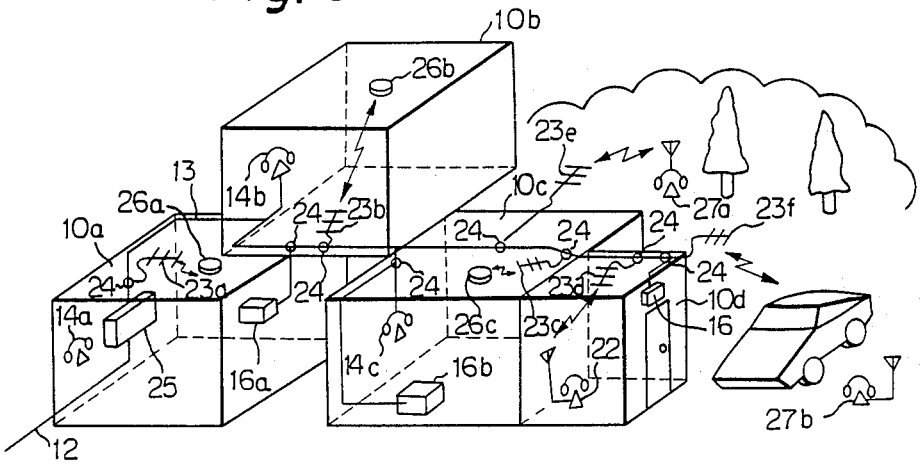
Fig. 3 PRIOR ART
FIG. 3 is a schematic view of another prior art HA system.

FIG. 3 shows another prior art HA system which is elaborated to eliminate the drawbacks discussed above. As shown, antennas 23*a* to 23*d* are installed in the individual rooms, and antennas 23*e* and 23*f* are installed outside of the house. The antennas 23*a* to 23*f* are connected to a coaxial cablke which is disposed in the distributing cable 13, by using multiple duplexers 24. The coaxial cable is connected to a transmit/receive circuit which is installed in a system controller 25, and the transmit/receive circuit is connected to a home telephone controller, a security controller and others within the system controller 25. In this kind of system, since the distance over which the mobile unit 22 or like cordless apparatus transmits and receives an electromagnetic wave is relatively short and since walls and others which attenuate electromagnetic waves do not intervene, the required power of electromagnetic output of the cordless apparatus may be reduced. In addition, fire alarms 26*a* to 26*c* or like cordless security equipment can be installed even in those locations to which the cable 13 cannot be laid with ease, and mobile units 27*a*, 27*b* and others of a cordless telephone system can be located outside of the house. It is to be noted that television receivers 16*a* and 16*b* are disposed in, respectively, the dining room 10*a* and the living room 10*c* and individually connected to the cable 13.

A problem with the prior art system of FIG. 3 is that the antennas 23*a* to 23*f* and the duplexers 24 adapted to interconnect the antennas and the cable 13 are indispensable, adding to the cost and rendering the implementation complicated and time- and labor-consuming.

Figure 4A:
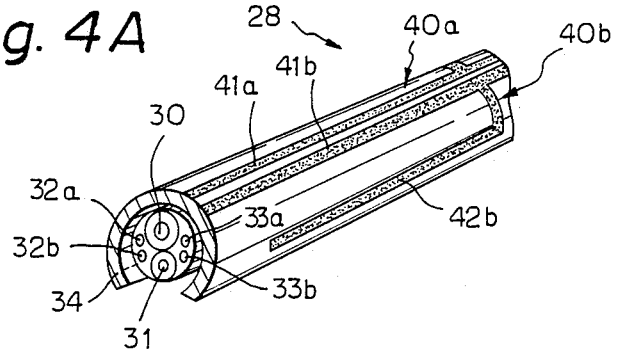
FIGS. 4A and 4B are, respectively, a perspective view and a fragmentary developed view of an antenna device embodying the present invention.
Figure 4B:
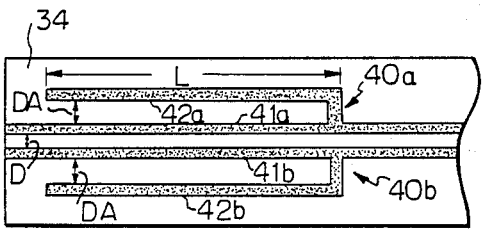

Referring to FIGS. 4A and 4B, an antenna device embodying the present invention is shown which solves the problems particular to the prior art systems as discussed above. The elongate body shown in FIG. 4A is a round composite distributing cable 28. As shown, the distributing cable 28 comprises coaxial cables 30 and 31, insulated paired wires 32*a* and 32*b*, and paired insulated wires 33*a*and 33*b*. The coaxial cables 30 and 31 and paired wires are bundled up and housed in a conduit or a sheath 34. Conductive patterns 40*a* and 40*b* are provided on the outer surface of the sheath 34 by, for example, printing technology. Specifically, the conductive patterns 40*a* and 40*b* may be printed on the sheath 34 by spraying conductive paint such as on which contains powder of semiconductor or metal, e.g., carbon graphite, copper or aluminum by use of a mask. The conductive pattern 40*a* is made up of a feeder pattern portion 41*a* and an antenna pattern portion 42*a*, and the conductive pattern 40*b* is made up of a feeder pattern portion 41*b* and an antenna pattern portion 42*b*. The feeder pattern portions 41*a* and 41*b* extend parallel to each other along the length of the sheath 34. The antenna pattern portions 42*a* and 42*b* extend out from, respectively, the same points of the feeder pattern portons 41*a* and 41*b*, as seen in the lengthwise direction of the latter, so that a symmetric pair of tuning-fork like patterns is formed. Each of the antenna pattern portions 42*a* and 42*b* is provided in multiple positions at predetermined intervals along the length of its associated feeder pattern portion 41*a* or 41*b*. Assuming that the wavelength of an electromagnetic wave to be received or radiated is λ, the length L of the antenna pattern portions 42*a* and 42*b* is preferred to be λ/2 2. n (n being a natural number). Further, the distance D between the feeder pattern portions 41*as* and 41*b* and the distance DA between the antenna pattern portion 42*a* (42*b*) and the feeder pattern portion 41*a*(41*b*) are individually suitably selected to form a desired characteristic impedance.

Figure 5:
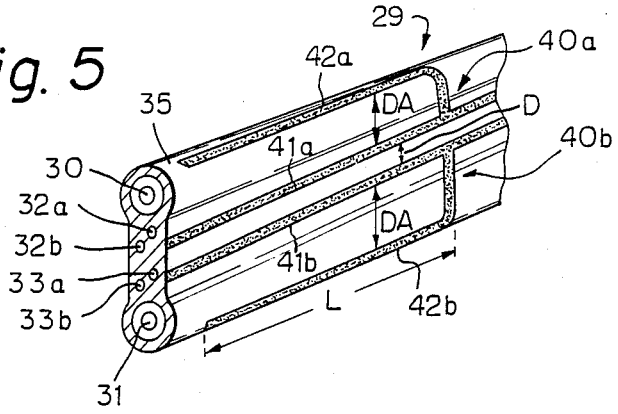
FIG. 5 is a perspective view of another embodiment of the present invention.
Figure 6:
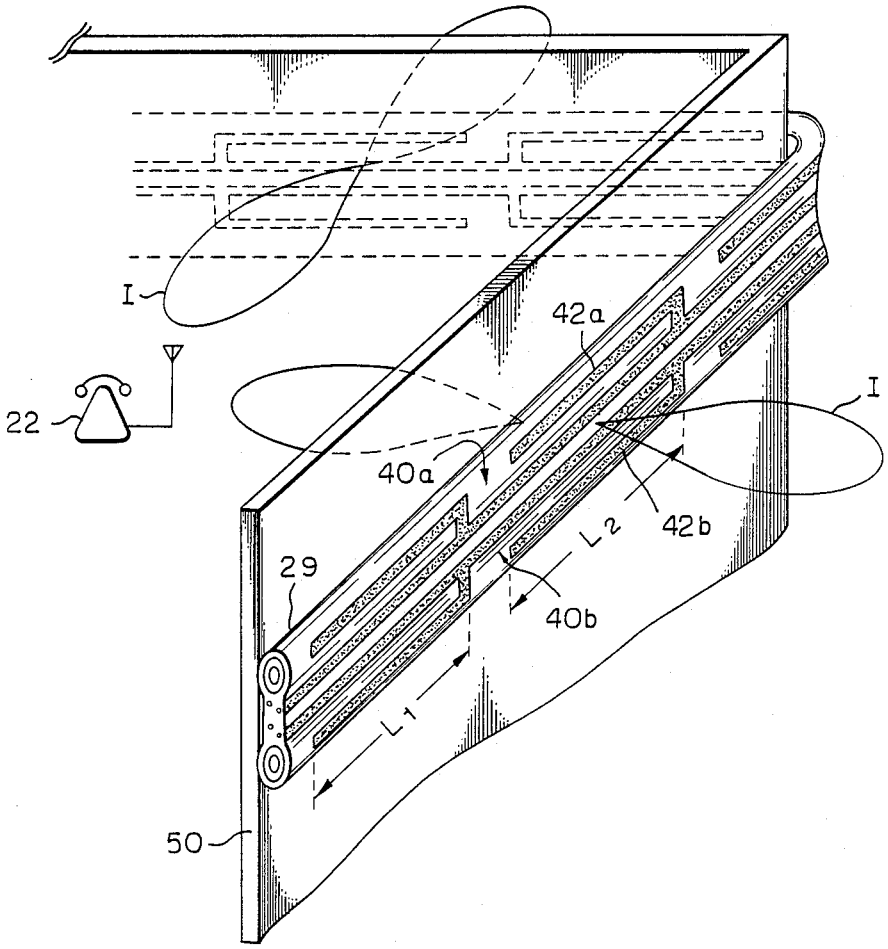
FIG. 6 is a perspective view showing a specific manner of installation of the antenna device as shown in FIG. 5.

Referring to FIG. 5, another embodiment of the present invention is shown in a perspective view. In this particular embodiment, a flexible distributing cable 29 has a flat composite configuration. In FIG. 5, the same or similar structural elements as those shown in FIGS. 4A and 4B are designated by like reference numerals. The coaxial cables 30 and 31 are spaced from each other by a predetermined distance and enclosed in a conduit or a sheath 35 in a generally cocoon configuration. The paired wires 32*a* and 32*b* and the paired wires 33*a* and 33*b* are buried in the sheath 35 in between the coaxial cables 30 and 31. Provided on the outer surface of the sheath 35 are the conductive patterns 40*a* and 40*b* which consist of, respectively, the feeder pattern portions 41*a* and 41*b* and the antenna pattern portions 42*a* and 42*b*. The flexible distributing cable 29 may be laid on the back of the inner walls 50 of a room, as shown in FIG. 6. The antenna pattern portions 42*a* and 42*b* have a narrow directivity pattern, as represented by lines I. A series of consecutively connected conductive patterns 40*a*and 40*b* serves as a multi-element array antenna and is capable of radiating and receiving electromagnetic waves to and from the mobile unit 22 and other cordless apparatuses. The length L of the antenna pattern portions 42*a* and 42*b* may be sequentially changed such as $L_1$ and $L_2$ which is greater than $L_1$, so as to broaden the frequency band of signals which are radiated and received by the conductive patterns 40*a* and 40*b*.

Figure 7:
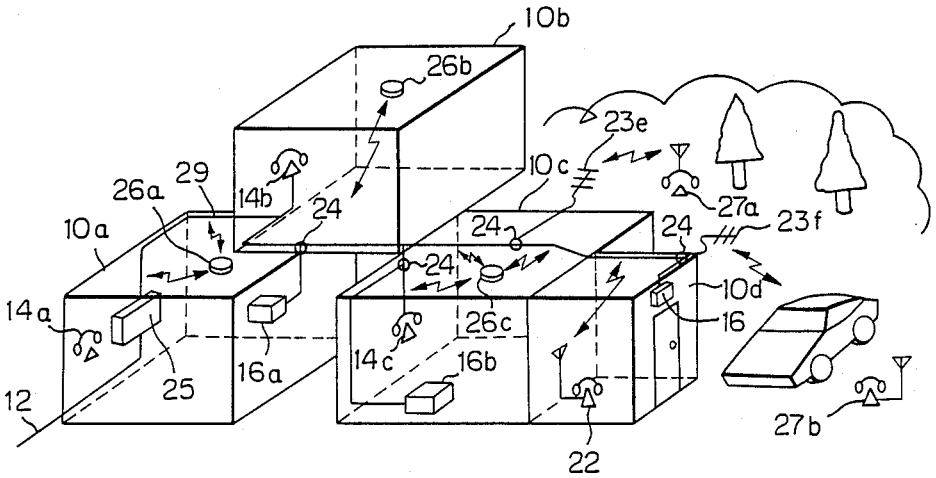
FIG. 7 is a schematic view of an HA system to which the present invention is applied.

FIG. 7 shows an HA system which is implemented with the distributing cable 29 (or 28) in accordance with the present invention. In FIG. 7, the same or similar portions as those shown in FIGS. 3, 4A and 4B are designated by like reference numerals. The system of FIG. 7 which wires the house by using the distributing cable 29 eliminates the need for the antennas 23*a* to 23d heretofore installed in individual rooms, as well as the need for the duplexers 24 adapted to connect the antennas 23*a* to 23*d* to the cable.

Assuming that the antenna 23 costs about 2,000 yen each, the duplexer 24 about 1,000 yen each, and the installation labor about 20,000 to 30,000 yen, the 6-antenna system shown in FIG. 3 would cost about 38,000 to 48,000 yen. In contrast, the use of the distributing cable of the present invention as in the system of FIG. 7 cuts down the cost to several thousands yen and, yet, saves space and simplifies the installation.

Figure 8A:
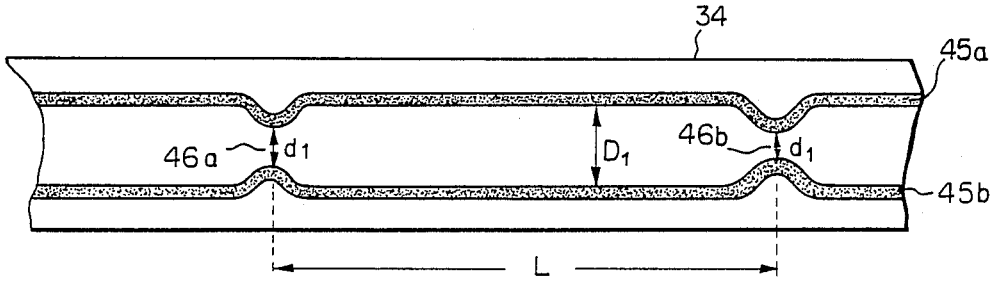
FIGS. 8A and 8B are views showing alternative conductive patterns in accordance with the present invention.
Figure 8B:
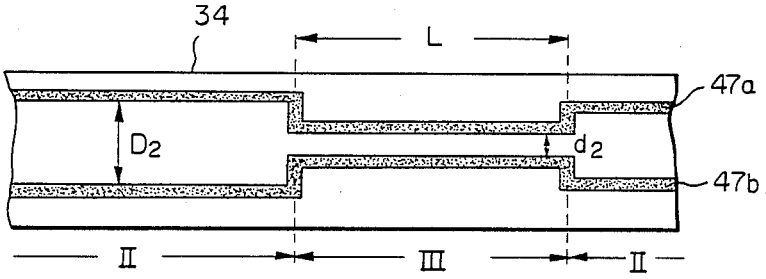

As shown in FIGS. 8A and 8B, the conductive patterns may not be accompanied with the antenna pattern portions. Specifically, in FIG. 8A, the conduit or the sheath 34 of the cable 28 is provided with conductive patterns 45*a* and 45*b* which extend substantially parallel to each other along the length of the sheath 34. While the conductive patterns 45*a* and 45*b* are spaced by a distance $D_1$ over a major part thereof, they approach each other at a pair of portions 46*a* and 46*b* which are defined at predetermined intervals along the length of the conductive patterns 45*a* and 45*b*. The distance between the conductive patterns 45*a* and 45*b* as measured at each of the portions 46*a* and 46*b* is $d_1$ which is smaller than $D_1$. In this configuration, since the characteristic impedance of the conductive patterns 45*a* and 45*b* differs from those particular portions 46*a* and 46*b* to the rest, a signal whose wavelength λ (=2. n . L) corresponds to the distance L between the paired portions 46*a* and 46*b* can be radiated and received at high efficiency.

In FIG. 8B, the sheath 34 is provided with substantially parallel conductive patterns 47*a* and 47*b* thereon. The conductive patterns 47*a* and 47*b* include a section II where they are spaced by a distance $D_2$, and a section III where they are spaced by a distance $d_2$ which is shorter than $D_2$. Each of the sections II and III repeats at predetermined intervals. The section III is provided with a length L. Again, since the characteristic impedance of the conductive patterns 47*a* a and 47*b* differs from the section II to the section III, a signal whose wavelength λ corresponds to the length L of the section III can be radiated and received efficiently.

In the case of FIGS. 8A and 8B, too, the distance L between the paired portions 46*a* and 46*b* (FIG. 8A) and the length L of the section III (FIG. 8B) may be sequentially changed to broaden the frequency band of signals which are radiated and received.

If desired, printing the conductive patterns 40*a* and 40*b* on the conduit or the sheath 34 or 35 as stated above may be replaced with bonding or inlaying conductive wires of the same shape as the conductive patterns 40*a* and 40*b*. Further, such conductive patterns or conductive wires may even be provided on a conduit of elongate body having any desired cross-section, e.g. a pipe for water, oil, gas or on other elongate electrically insulative materials either flexible or solid.

In order to feed the signal to or from the antenna device, a pair of feeding conductors (feeding) in a form of flat cable or coaxial cable may be connected respectively to the feeder pattern portions 41*a* and 41*b* or to the conductive patterns 45*a* (47*a*) and 45*b* (47*b*), and the feeding points may be selected for the best impedance matching between the antenna device and the feeder. An antenna coupling device may also be used. In the case of a single wire feeder, the feeder may be connected to one of the feeder pattern portions 41*a* and 41*b* or conductive patterns 45*a*45*b*47*a* and 47*b*, or to both of them which are tied to each other at a suitable point. In order to use the antenna device commonly by multiple mobile units 22, fire alarms 26, or other cordless devices, multiple feeding points are selected along the distributing cable 29.

In summary, it will be seen that the present invention provides an antenna device which allows a home automation system or like system including cordless apparatuses to be constructed without resorting to antennas otherwise installed in individual rooms, as well as duplexers individually associated with the antennas. This cut down the cost of the system and simplifies the installation to save time and labor required.

Various modifications will become possible for those skilled in the art after receiving the teachings of the present disclosure without departing from the scope thereof.

What is claimed is:

1. A cable with multiple antenna portions comprising:

(a) conducting means for carrying electrical energy;

(b) an insulating sheath covering said conducting means, said insulative sheath having an outer surface; and (c) a pair of feeder members, both of which are provided on the outer surface of said insulative sheath, said pair of feeder members extending continuously along said insulating sheath; and (d) a pair of antenna members extending respectively out from said pair of feeder members to form an antenna portion having a pair of tuning fork patterns extending along said insulative sheath, said pair of tuning fork patterns being symmetrical with respect to said pair of feeder members, said antenna portion being provided at multiple positions on said insulative sheath therealong at a predetermined interval to form said multiple antenna portions.

2. A cable as claimed in claim 1, wherein said multiple antenna portions include a first group in which said pair of antenna members have a first length and a second group in which said pair of antenna members have a second length different from said first length.

3. A cable as claimed in claim 1, wherein said pair of feeder members and said pair of antenna members comprise conductive paint printed on the outer surface of said insulative sheath.

4. A cable with multiple antenna portions comprising:

(a) conducting means for carrying electrical energy;

(b) an insulative sheath covering said conducting means, said insulating sheath having an outer surface; and (c) a pair of spaced and parallel conductive antenna members unconnected to each other and provided continuously on the outer surface of said insulative sheath and extending longitudinally therealong, the distance between said conductive members being partially and periodically reduced at a predetermined interval to form paired antenna portions, said antenna portions being defined between periodically reduced intervals.

5. A cable as claimed in claim 4, wherein said pair of conductive members comprise conductive paint printed on the outer surface of said insulative sheath.

6. A cable as claimed in claim 4, wherein the distance between adjacent paired portions is sequentially changed.

7. A cable as claimed in claim 4, wherein each of said paired portions has a length extending along said insulative sheath, the length being sequentially changed in size.

* * * * *